US010294598B2

(12) United States Patent
Long

(10) Patent No.: US 10,294,598 B2
(45) Date of Patent: May 21, 2019

(54) MULTI-PIPE QUANTITATIVE MEDIUM FILLING SYSTEM OF SUPERCRITICAL FLUID DYEING MACHINE

(71) Applicants: NANTONG TEXTILE & SILK INDUSTRIAL TECHNOLOGY RESEARCH INSTITUTE, Nantong, Jiangsu (CN); SOOCHOW UNIVERSITY, Suzhou (CN)

(72) Inventor: Jiajie Long, Suzhou (CN)

(73) Assignees: NANTONG TEXTILE & SILK INDUSTRIAL TECHNOLOGY RESEARCH INSTITUTE, Nantong (CN); SOOCHOW UNIVERSITY, Suzhou (CN)

( * ) Notice: Subject to any disclaimer, the term of this patent is extended or adjusted under 35 U.S.C. 154(b) by 130 days.

(21) Appl. No.: 15/557,105

(22) PCT Filed: Jun. 8, 2016

(86) PCT No.: PCT/CN2016/085184

§ 371 (c)(1),
(2) Date: Sep. 10, 2017

(87) PCT Pub. No.: WO2017/206195

PCT Pub. Date: Dec. 7, 2017

(65) Prior Publication Data

US 2018/0094373 A1 Apr. 5, 2018

(30) Foreign Application Priority Data

May 30, 2016 (CN) ..... 2016 1 0368954

(51) Int. Cl.

| | |
|---|---|
| ***D06B 9/02*** | (2006.01) |
| ***D06B 23/20*** | (2006.01) |
| ***D06B 19/00*** | (2006.01) |
| ***D06P 1/94*** | (2006.01) |
| *D06B 23/10* | (2006.01) |

(52) U.S. Cl.
CPC ..... *D06B 9/02* (2013.01); *D06B 19/00* (2013.01); *D06B 23/205* (2013.01); *D06P 1/94* (2013.01); *D06B 23/10* (2013.01); *D06B 23/20* (2013.01)

(58) Field of Classification Search
CPC .. D06P 1/94; D06B 9/02; D06B 19/00; D06B 23/10; D06B 23/20; D06B 23/205
See application file for complete search history.

(56) References Cited

U.S. PATENT DOCUMENTS 3,871,821 A * 3/1975 Winn ..... D06B 9/02 8/149.1
5,666,827 A * 9/1997 Gunter ..... D06B 23/20 68/27

(Continued)

FOREIGN PATENT DOCUMENTS

CN 2688735 Y 3/2005
CN 201520892 U 7/2010

(Continued)

*Primary Examiner* — Joseph L. Perrin
(74) *Attorney, Agent, or Firm* — SZDC Law P.C.

(57) ABSTRACT

The invention relates to a multi-pipe quantitative medium filling system of a supercritical fluid waterless dyeing machine. The system comprises a supercritical fluid medium reservoir, a stop valve, and a medium filter sequentially connected by a high-pressure main pipe, and at least two filling branches independent of each other and connected to the medium filter. Each filling branch includes a booster pump, a supercritical fluid high-pressure mass flowmeter, a ball valve, and a dyeing unit sequentially connected along a medium forward direction by a high-pressure branch pipe. By using a mass-measurement filling system having multiple branches independent of each other, the invention can effectively realize simultaneous and accurate quantitative medium filling for separate dyeing units and differentiated filling for dyeing units with different medium masses, thus (Continued)

overcoming disadvantages such as unreliability, inaccuracy and low use efficiency of a conventional method, and also making a dyeing operation simple and scientifically feasible.

8 Claims, 1 Drawing Sheet

(56) References Cited

U.S. PATENT DOCUMENTS

| | | | | |
|---|---|---|---|---|
| 5,938,794 | A * | 8/1999 | Eggers | D06B 5/16 8/475 |
| 5,953,780 | A * | 9/1999 | Schollmeyer | D06B 5/12 8/158 |
| 6,129,451 | A * | 10/2000 | Rosio | B08B 7/0021 366/173.2 |
| 6,397,421 | B1 * | 6/2002 | Brainard | D06F 43/007 68/18 R |
| 2002/0108183 | A1 * | 8/2002 | Smith | D06B 19/00 8/115.51 |
| 2018/0119324 | A1 * | 5/2018 | Long | B01D 46/0068 |

FOREIGN PATENT DOCUMENTS

| | | | |
|---|---|---|---|
| CN | 103422288 | A | 12/2013 |
| CN | 105133396 | A | 12/2015 |
| DE | 10025155 | A1 | 12/2001 |
| JP | 2001295175 | A | 10/2001 |

* cited by examiner

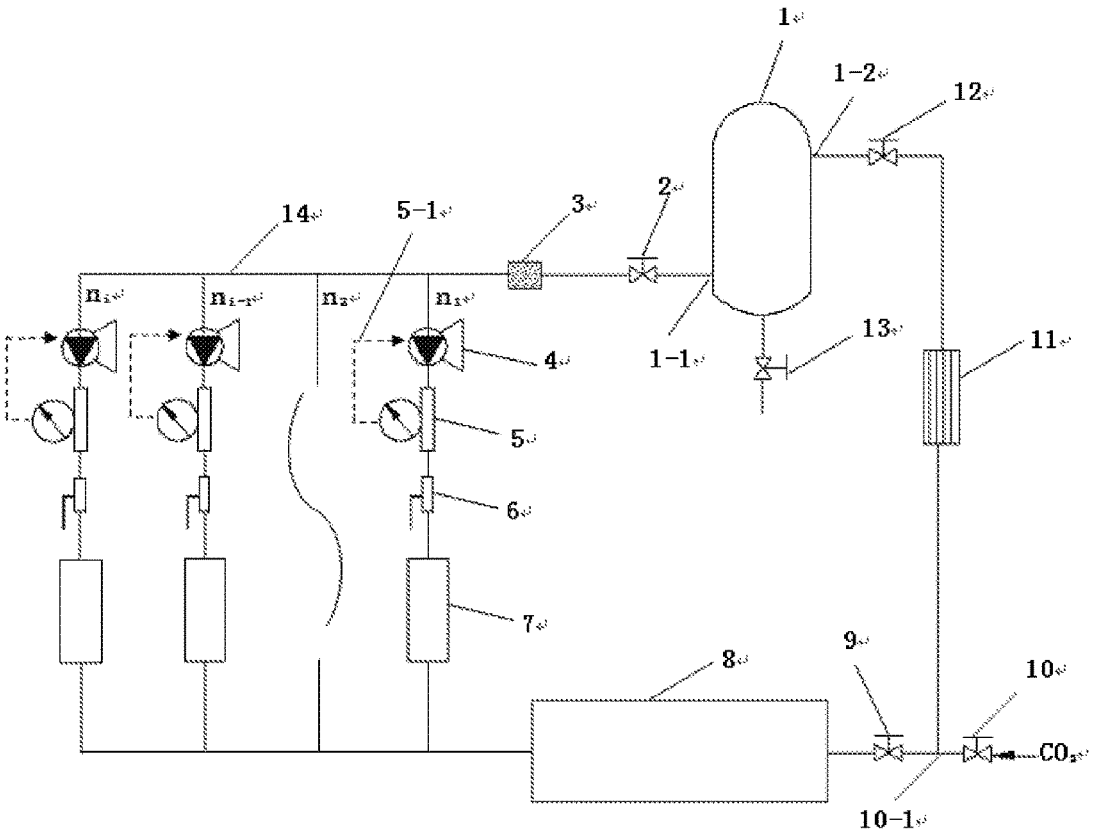
1
1-2
12
2
3
14
5-1
$n_1$
$n_{i-1}$
$n_2$
$n_i$
4
1-1
13
11
5
6
7
8
9
10
$CO_2$
10-1

MULTI-PIPE QUANTITATIVE MEDIUM FILLING SYSTEM OF SUPERCRITICAL FLUID DYEING MACHINE

This application is a national stage application of PCT/CN2016/085184, filed on Jun. 8, 2016, which claims the priority to Chinese Patent Application No. 201610368954.7, filed on May 30, 2016, all of which are incorporated herein by reference in their entirety.

FIELD OF THE INVENTION

The present invention relates to the field of manufacturing technologies of a pressure vessel and a textile dyeing and finishing facility, and more particularly to a multi-pipe quantitative medium filling system of a supercritical fluid waterless dyeing machine.

DESCRIPTION OF THE RELATED ART

Supercritical $CO_2$ fluid is an environmental-friendly and safe fluid medium. The use of the supercritical $CO_2$ fluid in place of the conventional water bath for pre-treatment, dyeing, or after-treatment on textiles can achieve environmental-friendly and ecological production of textiles fundamentally, and also have advantages such as energy saving. Therefore, development of the waterless dyeing and finishing technology using a supercritical fluid, represented by the supercritical $CO_2$ fluid, and the equipment system thereof is a technological revolution to the conventional textile printing and dyeing industry, and is of great significance for realizing sustainable development of the industry, ecological environmental protection, and so on.

With the development of technology in recent years, the supercritical $CO_2$ waterless dyeing technology for textiles has entered the commercialization stage. The applicable equipment systems have also been developed vigorously. For example, processing modes such as vertical or horizontal beam dyeing, and dual-axis jig dyeing and rope dyeing with the supercritical $CO_2$ fluid appear successively.

Chinese Invention Patent entitled "Production System for Continuous Dyeing with Supercritical Fluid and Production Process Thereof" (CN101024922A) discloses an integrated dyeing vessel and system, including a supercritical fluid supply device, a dyeing circulation device, and a supercritical fluid recycling device which are in communication with each other, where the dyeing circulation device includes at least two integrated dyeing vessels. By means of the integrated dyeing vessel, dye dissolution and fabric dyeing with a supercritical fluid at a pressure of 10 to 45 MPa and a temperature of 100 to 180° C. can be performed in the same vessel.

In Chinese Invention Patent entitled "Process and Device for Treating Textile Substrate with Supercritical Fluid" (CN1200153A), a vertical beam high-pressure dyeing vessel and system for dyeing textiles packaged as rolls or spools of yarn is disclosed. In addition, the processing temperature and time can be controlled and adjusted. For example, dyeing can be performed under a constant pressure such as 280 bars and an elevated processing temperature.

In Chinese Invention Patent No. CN101824716A and entitled "Device and Method for Fabric Dyeing with Supercritical Carbon Dioxide Fluid." a special seamless warp beam consisting of an inner layer and an outer layer is disclosed, where a seamless woven cylindrical net-like wrap is sleeved outside the outermost layer of wound fabric, and a dyeing process with alternating circulating fluid and static fluid is performed using supercritical carbon dioxide fluid at a pressure of 10 MPa to 30 Mpa and at a temperature of 90° C. to 140° C., to achieve uniform dyeing of the fabric to be piece-dyed in the supercritical carbon dioxide fluid. It is disclosed in Chinese Invention Patent No. CN102747566A and entitled "Fabric Rope Dyeing Machine and Dyeing Method Using Supercritical Carbon Dioxide Fluid as Medium" that, a cloth lifting roller system is arranged in a dyeing vessel, to drive the rope-shaped fabric to circulate in sequence in conjunction with a traction action of a cloth guiding cable, wherein the process parameters, such as a circulation flow rate of the dyeing fluid, a circulating speed of the fabric and a temperature and pressure of the dyeing, are rationally controlled to achieve uniform piece-dyeing for the rope-shaped fabric in the supercritical carbon dioxide fluid medium. In addition, Chinese Invention Patent No. CN101760914A and entitled "Supercritical Dyeing Machine" also discloses a rope-shaped fabric piece dyeing machine comprising a dyeing circulation system, a cloth feeding system, a separation and recycling system and the like, achieving loose and tension-free waterless dyeing treatment of the fabric.

However, all the processing equipment systems for supercritical fluid waterless dyeing as disclosed above generally control behaviors such as dye dissolution and dye up-take by adjusting the pressure of the medium in the system at a certain temperature, to achieve processing such as dyeing for textiles. In other words, currently, in all these equipment systems, the amount of the dyeing medium needed is indirectly controlled by the system pressure at a particular target dyeing temperature. However, during an actual operation, especially when the pressure of the system is boosted, generally, it is impossible to accurately realize that the medium entering the system in one time of boosting exactly meets the required dyeing pressure or the required amount of the dyeing medium when the system temperature is increased to the target dyeing temperature. Therefore, with reference to the prior experience, the pressure of the system is generally continued to be boosted or reduced multiple times when the system temperature reaches or is about to reach the dyeing temperature. Obviously, such a filling or boosting mode for the system medium is extremely unreliable and inaccurate. It makes operations in the dyeing procedure complicated, and more importantly, it may cause the dyeing process conditions to fluctuate and change during multiple pressure adjustment procedures, and especially, it easily changes the dyeing temperature and time during pressure adjustment, thus increasing the dyelot chromatism of products and making it difficult to control the reproducibility. Accordingly, the rate of certified products in the waterless dyeing and the application and promotion of industrialization production of the waterless dyeing are also greatly affected. Furthermore, currently boosting or filling systems of general supercritical fluid waterless dyeing machines all correspond to stationary dye vats in a one-to-one manner, and thus have low use efficiency and are not suitable for industrialized production, especially for high-efficiency and differentiated requirements of commercial dithering, proofing and so on.

SUMMARY OF THE INVENTION

The object of the present invention is to overcome the above problems in the prior art, and provides a multi-pipe quantitative medium filling system of a supercritical fluid waterless dyeing machine. The system is a multi-pipe quantitative medium filling system in a mass measurement mode, and can realize simultaneous and accurate filling and boosting in one time or differentiated filling and boosting for multiple separate dyeing units of the supercritical fluid waterless dyeing machine, and thus has advantages such as high efficiency, simple operations, no influence on dyeing process conditions, small dyelot chromatism of products, good reproducibility, desirable stability and reliability, as well as wide application range.

In order to achieve the above purpose and technical effects, the invention provides a multi-pipe quantitative medium filling system of a supercritical fluid waterless dyeing machine, the system comprises a supercritical fluid medium reservoir, a stop valve, and a medium filter sequentially connected by a high-pressure main pipe, and at least two filling branches independent of each other and connected to the medium filter. Each of the filling branches comprises a booster pump, a supercritical fluid high-pressure mass flowmeter, a high-pressure ball valve and a dyeing unit which are sequentially connected along a medium forward direction by a high-pressure branch pipe.

The supercritical fluid medium reservoir is provided with a medium inlet connected to a gas source, and a medium outlet connected to the stop valve by the high-pressure main pipe.

An entry end of the booster pump is in communication with the high-pressure main pipe to be connected with the medium filter, and an exit end of the booster pump is in communication with the supercritical fluid high-pressure mass flowmeter. The start and stop of the booster pump is controlled by the supercritical fluid high-pressure mass flowmeter.

An entry end of the supercritical fluid high-pressure mass flowmeter is in communication with the booster pump by the high-pressure branch pipe, and an exit end of the supercritical fluid high-pressure mass flowmeter is in communication with the high-pressure ball valve by the high-pressure branch pipe. The supercritical fluid high-pressure mass flowmeter is connected to the booster pump in a coordinated control manner, and the start and stop of the booster pump is controlled by coordinated control signals for measurement and transmission of the mass, density, and temperature of a passing supercritical fluid, and presetting of a required fluid mass.

One end of the high-pressure ball valve is in communication with the supercritical fluid high-pressure mass flowmeter by the high-pressure branch pipe, and the other end of the high-pressure ball valve is connected to the dyeing unit for quantitatively filling the dyeing media.

Preferably, the gas source passes through a high-pressure pipe and a stop valve, and enters the supercritical fluid medium reservoir after being treated by a condenser.

Preferably, the medium inlet is provided at a distance of 10 to 50 cm from the top of the supercritical fluid medium reservoir, and the medium outlet is provided at a distance of 5 to 50 cm from the bottom of the supercritical fluid medium reservoir.

Preferably, the supercritical fluid high-pressure mass flowmeter has an applicable pressure of 0 to 70 MPa and a applicable temperature of −50° C. to 150° C.

Preferably, the booster pump is selected from a group consisting of a gas booster pump, a liquid booster pump, a high-pressure plunger pump and a diaphragm pump.

Preferably, the dyeing units may be further connected with a separation and recycling device by the high-pressure main pipe, and the separation and recycling device is connected with the condenser by means of a stop valve.

Preferably, the stop valve for introducing the gas source and the stop valve connected with the separation and recycling device are connected with the condenser by a high-pressure three-way pipe.

Preferably, the dyeing unit is a stationary high-pressure dye vat or a mobile high-pressure treatment container.

By means of the above technical solution, as compared with the prior art, the present invention has the following advantages: by using a mass-measurement-mode filling system having multiple branches independent of each other, the present invention can effectively realize simultaneous and accurate quantitative medium filling for multiple separate dyeing units and differentiated filling for different dyeing units with different medium masses, thereby overcoming the disadvantages such as unreliability, inaccuracy, and low use efficiency existing in a conventional method, and also making a dyeing operation procedure simple and scientifically feasible. In addition, by using the filling system of the present invention, fluctuations and changes in dyeing process conditions caused by multiple pressure adjustment procedures in the conventional method can be avoided, and therefore, the dyelot chromatism can be alleviated or reduced, and the reproducibility of products can be improved. Furthermore, the present invention is also applicable to industrialized production of supercritical fluid waterless dyeing, especially for high-efficiency and differentiated accurate filling requirements of commercial dithering, proofing, and so on. Therefore, the present invention can significantly improve the production and processing efficiency of supercritical fluid waterless dyeing and the rate of certified products in waterless dyeing, and has a broad application prospect and practical significance in fundamentally addressing the generation and emission of pollutants in the textile printing and dyeing industry and realizing energy conservation, consumption reduction, emission reduction, and clean production of the textile printing and dyeing industry.

BRIEF DESCRIPTION OF THE DRAWINGS

FIG. 1 is a schematic view showing the working principle of a supercritical fluid dyeing machine according to an embodiment of the present invention.

In the drawings, 1. supercritical fluid medium reservoir; 1-1. medium outlet; 1-2 medium inlet; (2, 9, 10, 12, 13) stop valve; 3. medium filter; 4. booster pump; 5. supercritical fluid high-pressure mass flowmeter; 5-1 coordinated control signal of the mass flowmeter and the booster pump; 6. ball valve; 7. dyeing unit; 8. separation and recycling device; 10-1. high-pressure three-way pipe; 11. condenser; 14. high-pressure main pipe; ($n_1$, $n_2$, . . . , $n_{i-1}$, $n_i$, $i \geq 2$). filling branches.

DETAILED DESCRIPTION OF THE PREFERRED EMBODIMENTS

The invention will be further illustrated in more detail with reference to the accompanying drawings and embodiments. It is noted that, the following embodiments only are intended for purposes of illustration, but are not intended to limit the scope of the present invention.

Referring to FIG. 1, a multi-pipe quantitative medium filling system of a supercritical fluid waterless dyeing machine in a preferred embodiment of the present invention, comprises a supercritical fluid medium reservoir 1, a stop valve 2, and a medium filter 3 sequentially connected by a high-pressure main pipe 14, and at least two filling branches independent of each other and connected to the medium filter 3. Each filling branch includes a booster pump 4, a supercritical fluid high-pressure mass flowmeter 5, a high-pressure ball valve 6, and a dyeing unit 7 which are sequentially connected along a medium forward direction by a high-pressure branch pipe.

The filling branches $n_1, n_2, \ldots, n_{i-1}, n_i$ ($i \geq 2$) independent of each other are in communication with the high-pressure main pipe 14 sequentially. In each filling branch, the booster pump 4, the supercritical fluid high-pressure mass flowmeter 5, the high-pressure ball valve 6, and the dyeing unit 7 are sequentially connected by a high-pressure branch pipe along the medium forward direction. The entry end of each of the booster pumps 4 is in communication with the high-pressure main pipe 14, and the exit end of each of the booster pumps 4 is connected to the supercritical fluid high-pressure mass flowmeters 5. In addition, the exit end of the supercritical fluid high-pressure mass flowmeter 5 is in communication with the high-pressure ball valve 6 by the high-pressure branch pipe, and the high-pressure ball valve 6 is connected to the dyeing unit 7 by the high-pressure branch pipe. The supercritical fluid high-pressure mass flowmeter 5 can directly implement the measurement and display of the mass, density, and temperature of the supercritical fluid flowing through the branch where the supercritical fluid high-pressure mass flowmeter 5 is located, and can preset a required fluid mass, thereby realizing coordinated control over the start/stop and flow of the booster pump 4 by using a coordinated control signal 5-1 of the supercritical fluid high-pressure mass flowmeter 5 and the booster pump 4, to achieve quantitative mass filling of the supercritical fluid medium in each separate dyeing unit 7.

The medium filter 3 on the high-pressure main pipe 14 is connected to the medium outlet 1-1 of the supercritical fluid medium reservoir 1. The medium filter 3 can achieve and ensure purification treatment for the medium to be filled.

Under the coordinated control of the corresponding supercritical fluid high-pressure mass flowmeters 5 and the booster pumps 4, the filling branches $n_1, n_2, \ldots, n_{i-1}, n_i$ ($i \geq 2$) independent of each other can realize simultaneous and accurate quantitative medium filling for multiple independent dyeing units 7 and differentiated filling of different medium masses for different dyeing units 7.

A medium gas source required by the system of the present invention is connected into the system by a high-pressure three-way pipe 10-1 and a stop valve 10, and after being treated by a condenser 11, the gas source enters the supercritical fluid medium reservoir 1 for later use.

In each branch, by the high-pressure branch pipe, one end of the high-pressure ball valve 6 is in communication with the dyeing unit 7, and the other end is in communication with the supercritical fluid high-pressure mass flowmeter 5. By opening the high-pressure ball valve 6, the supercritical fluid medium reservoir 1 is in communication with the dyeing unit 7, to quantitatively fill the dyeing unit 7 with the required dyeing medium.

In each branch, the booster pump 4 may be a gas booster pump, a liquid booster pump, a high-pressure plunger pump or a diaphragm pump. The outlet of the booster pump 4 is in communication with the supercritical fluid high-pressure mass flowmeter 5 by the high-pressure branch pipe. The start/stop and flow of the booster pump 4 are controlled by an output signal from the downstream supercritical fluid high-pressure mass flowmeter 5, to realize quantitative filling for the dyeing unit 7.

The supercritical fluid medium reservoir 1 is provided with a medium outlet 1-1 and a medium inlet 1-2. The medium outlet 1-1 is disposed at a distance of 5 to 50 cm from the bottom of the supercritical fluid medium reservoir 1, and is connected to the stop valve 2 by the high-pressure main pipe 14, and the stop valve 2 is further connected to the medium filter 3. The medium inlet 1-2 is disposed at a distance of 10 to 50 cm from the top of the supercritical fluid medium reservoir 1, and is connected to a stop valve 12 and the condenser 11 successively by the high-pressure main pipe, to achieve the functions such as receipt, storage, and output of the medium gas source.

The dyeing units 7 independent of each other may be various stationary high-pressure dye vats of different forms, different shapes, and different volumes, or may be mobile high-pressure treatment containers for textile dyeing, pre-treatment or after-treatment. One end of the dyeing unit 7 is connected to the high-pressure ball valve 6, and the other end may be or not be connected to a separation and recycling device 8, a stop valve 9, and the condenser 11 successively as required.

When the multi-pipe quantitative medium filling system of a supercritical fluid waterless dyeing machine according to the present invention operates, first, the stop valves 9, 13 and 2 are closed, and the stop valves 10 and 12 and the condenser 11 are opened. The medium gas source is used for filling the storage medium for the supercritical fluid medium reservoir 1 by the high-pressure three-way pipe 10-1. After the filling is finished, the stop valve 10 is closed, and the gas source is cut off. The dyeing units 7 to be filled are connected into the filling branches $n_1, n_2, \ldots, n_{i-1}, n_i$ ($i \geq 2$) by the high-pressure branch pipes respectively, and are connected to the high-pressure ball valves 6 in the branches respectively. Also, medium masses required for dyeing are preset by means of the corresponding supercritical fluid high-pressure mass flowmeters 5 respectively. Then, the stop valve 2 in the high-pressure main pipe 14 is opened, and the high-pressure ball valves 6 in the branches are opened, to start the supercritical fluid high-pressure mass flowmeters 5 in the branches to quantitatively fill the dyeing units 7 with the dyeing medium. In addition, the supercritical fluid high-pressure mass flowmeter 5 in each branch monitors and displays the temperature, density, transient flow and accumulated flow of the medium flowing through the branch, and transmits the mass information of the medium to be filled to the corresponding booster pump 4 by the coordinated control signal 5-1, to realize coordinated control over the start/stop and flow of the booster pump 4, thereby achieving the one-time, accurate and quantitative filling of the required supercritical fluid medium for each corresponding dyeing unit 7. When the predetermined filling mass of the medium is reached in a dyeing unit 7, the corresponding booster pump 4 is automatically stopped, and then the high-pressure ball valve 6 in the branch is closed, and thus the quantitative filling for the dyeing unit 7 is accomplished.

For the stationary dyeing unit, after the filling is finished, the temperature of each dyeing unit may be increased directly according to a predetermined dyeing process, to complete the dyeing procedure. For the mobile dyeing unit, the dyeing unit may be disconnected from the filling branch, and then moved into an appropriate device for heating and dyeing. Furthermore, for each filling branch, the foregoing procedure may be repeated to continue quantitative filling for other dyeing units to be filled, to realize the efficient utilization of the filling and boosting system.

Furthermore, a stationary dyeing unit or a mobile dyeing unit, may be connected to the separation and recycling device 8 as required after the dyeing is finished, to accomplish separation and recycling of the dyeing medium and residual dye, and treatment of products after dyeing, and so on.

The above description is only preferred embodiments of the present invention and not intended to limit the present invention, it should be noted that those of ordinary skill in the art can further make various modifications and variations without departing from the technical principles of the present invention, and these modifications and variations also should be considered to be within the scope of protection of the present invention.

What is claimed is:

1. A multi-pipe quantitative medium filling system of a supercritical fluid waterless dyeing machine, comprising:

a supercritical fluid medium reservoir, a stop valve, and a medium filter sequentially connected by a high-pressure main pipe; and at least two filling branches independent of each other and connected to the medium filter, and each of the filling branches comprising a booster pump, a supercritical fluid high-pressure mass flowmeter, a high-pressure ball valve and a dyeing unit which are sequentially connected along a medium forward direction by a high-pressure branch pipe, wherein the supercritical fluid medium reservoir is provided with a medium inlet connected to a gas source, and a medium outlet connected to the stop valve by the high-pressure main pipe;

an entry end of the booster pump being in communication with the high-pressure main pipe to be connected with the medium filter, an exit end of the booster pump being in communication with the supercritical fluid high-pressure mass flowmeter, and the start and stop of the booster pump being controlled by the supercritical fluid high-pressure mass flowmeter;

an entry end of the supercritical fluid high-pressure mass flowmeter being in communication with the booster pump by the high-pressure branch pipe, an exit end of the supercritical fluid high-pressure mass flowmeter being in communication with the high-pressure ball valve by the high-pressure branch pipe, and the supercritical fluid high-pressure mass flowmeter being connected to the booster pump in a coordinated control manner, and the start and stop of the booster pump being controlled by coordinated control signals for measurement and transmission of the mass, density and temperature of a passing supercritical fluid, and presetting of a required fluid mass; and one end of the high-pressure ball valve being in communication with the supercritical fluid high-pressure mass flowmeter by the high-pressure branch pipe, and the other end of the high-pressure ball valve being connected to the dyeing unit for quantitatively filling the dyeing media.

2. The multi-pipe quantitative medium filling system of a supercritical fluid waterless dyeing machine as claimed in claim 1, wherein the gas source passes through a high-pressure pipe and a stop valve, and enters the supercritical fluid medium reservoir after being treated by a condenser.

3. The multi-pipe quantitative medium filling system of a supercritical fluid waterless dyeing machine as claimed in claim 2, wherein the dyeing units are further connected with a separation and recycling device by the high-pressure main pipe, and the separation and recycling device being connected with the condenser by means of a stop valve.

4. The multi-pipe quantitative medium filling system of a supercritical fluid waterless dyeing machine as claimed in claim 3, wherein the stop valve for introducing the gas source and the stop valve connected with the separation and recycling device are connected with the condenser by a high-pressure three-way pipe.

5. The multi-pipe quantitative medium filling system of a supercritical fluid waterless dyeing machine as claimed in claim 4, wherein the dyeing unit is a stationary high-pressure dye vat or a mobile high-pressure treatment container.

6. The multi-pipe quantitative medium filling system of a supercritical fluid waterless dyeing machine as claimed in claim 1, wherein the medium inlet is provided at a distance of 10 to 50 cm from the top of the supercritical fluid medium reservoir, and the medium outlet is provided at a distance of 5 to 50 cm from the bottom of the supercritical fluid medium reservoir.

7. The multi-pipe quantitative medium filling system of a supercritical fluid waterless dyeing machine as claimed in claim 1, wherein the supercritical fluid high-pressure mass flowmeter has an applicable pressure of 0 to 70 MPa and a applicable temperature of −50° C. to 150° C.

8. The multi-pipe quantitative medium filling system of a supercritical fluid waterless dyeing machine as claimed in claim 1, wherein the booster pump is selected from a group consisting of a gas booster pump, a liquid booster pump, a high-pressure plunger pump and a diaphragm pump.

* * * * *